US005188744A

United States Patent [19]

Silverman

[11] Patent Number: 5,188,744

[45] Date of Patent: Feb. 23, 1993

[54] ICE CUBE DISPENSER TRAY

[76] Inventor: Ethan E. Silverman, 45 W. 67th St., Apt. 7G, New York, N.Y. 10023

[21] Appl. No.: 833,335

[22] Filed: Feb. 10, 1992

[51] Int. Cl.[5] ..... B28B 7/24; F25C 1/24

[52] U.S. Cl. ..... 249/121; 221/91; 249/119; D15/90

[58] Field of Search ..... 249/119, 120, 121, 127; 221/91; D15/90

[56] References Cited

U.S. PATENT DOCUMENTS

| | | | |
|---|---|---|---|
| 2,389,530 | 11/1945 | Miner | 249/120 |
| 2,503,693 | 4/1950 | Lennep | 249/121 |
| 2,591,261 | 4/1952 | Holahan | 249/119 |
| 3,135,101 | 6/1964 | Nigro | D15/90 |
| 3,374,982 | 3/1968 | Sallade | 249/121 |
| 3,414,229 | 12/1968 | Norberg | 249/121 |
| 3,776,504 | 12/1973 | Wiley | 249/121 |
| 4,164,301 | 8/1979 | Thayer | 221/91 |
| 4,432,529 | 2/1984 | McMillan | 249/52 |
| 4,967,995 | 11/1990 | Burgess | 249/70 |
| 5,044,600 | 9/1991 | Shannon | 249/120 |

*Primary Examiner*—Jay H. Woo
*Assistant Examiner*—James P. Mackey
*Attorney, Agent, or Firm*—Leo Zucker

[57] ABSTRACT

An ice cube dispenser tray capable of dispensing only a desired number of ice cubes into a glass or container without dropping of additional unwanted cubes from the tray, includes an elongate tray body having separate ice cube compartments aligned in succession along the length of the tray body, and a pair of compartment cover panels. Guide channels formed in the tray body enable the pair of cover panels to slide just above the ice cube compartments so that ice cubes can be dispensed out of the tray body only from those compartments that are exposed by movement of the cover panels. Ice cubes in compartments beneath the cover panels are blocked by the panels from falling free of the tray body.

15 Claims, 1 Drawing Sheet

ICE CUBE DISPENSER TRAY

BACKGROUND OF THE INVENTION

1. Field of the Invention

The present invention relates generally to ice cube trays, and particularly to a handy, spill resistant ice cube dispenser tray that allows only a desired number of ice cubes to drop from the tray into a glass or container while remaining ice cubes are held in their compartments.

2. Description of the Known Art

Ice cube trays arranged with removable covers for purposes of avoiding spills are generally known. For example, U.S. Pat. No. 3,776,504 (Dec. 4, 1973) discloses a spill-proof ice cube tray having cover elements hinged to the long sides of the tray. When the cover elements are closed, inner portions of the ice cube compartments are left exposed to allow for filling of the compartments with water. The cover elements are designed to deflect splashed water away from the outer edges of the elements and back into the ice cube compartments, according to the patent.

U.S. Pat. No. 4,967,995 (Nov. 6, 1990) discloses a flexible plastics ice cube tray and a separate cover. The cover has a top portion that completely overlies ice cube compartments in the tray, and cover side walls with flanges that retain the entire cover in place over the ice cube tray. The cover can be shifted endwise relative to the tray in telescoping fashion to expose a desired number of cubes, and the tray then inverted to dump the cubes from the exposed compartments.

A stackable ice cube tray and lid assembly is disclosed in U.S. Pat. No. 4,432,529 (Feb. 21, 1984).

SUMMARY OF THE INVENTION

An object of the invention is to provide an ice cube dispenser tray capable of dispensing only a desired number of ice cubes into a glass or container.

Another object of the invention is to provide an ice cube dispenser tray which, after filling with water, can be carried to a freezer compartment without inadvertently splashing the water out of the tray.

Another object of the invention is to provide an ice cube dispenser tray having multiple slidable cover panels each of which panels covers less than the entire number of ice cube compartments formed in the tray.

A further object of the invention is to provide an ice cube dispenser tray that is relatively inexpensive to manufacture and both easy and convenient to use.

According to the invention, an ice cube dispenser tray comprises an elongate ice cube tray body having separate ice cube compartments arranged successively in the long direction of the tray body. Guiding means associated with the tray body serves to guide a pair of compartment cover panels for sliding movement just above the ice cube compartments so that ice cubes can be dispensed out of the tray body only from those compartments that are exposed by movement of the cover panels.

Other and further objects, advantages and features of the invention will become apparent from the following description when read in connection with the accompanying drawing.

DETAILED DESCRIPTION OF THE INVENTION

Figure 1:
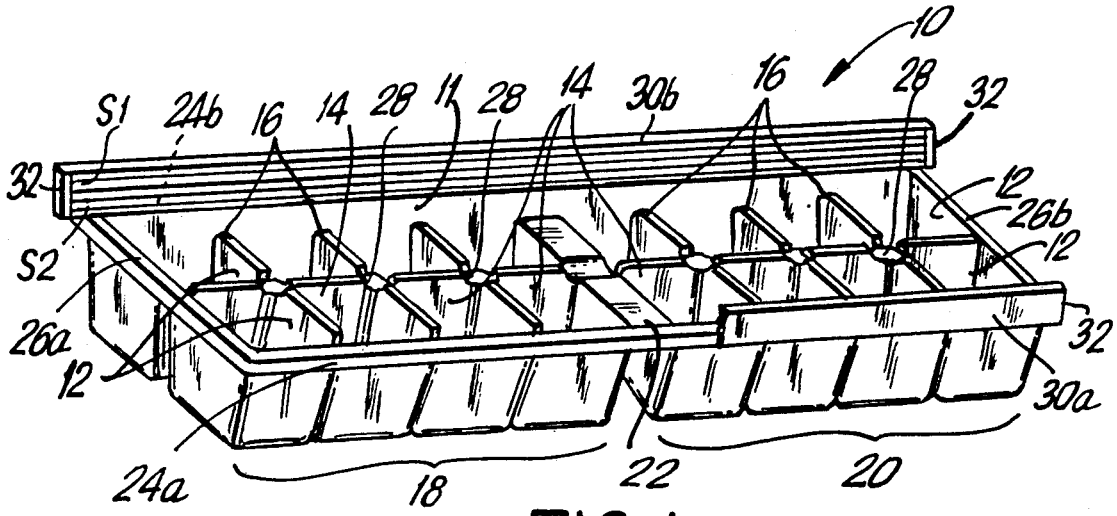
FIG. 1 is a perspective view of an ice cube dispenser tray according to the invention.

FIG. 1 is a perspective view of an ice cube dispenser tray 10 according to the invention. In the present embodiment, the tray 10 has a tray body 11 molded of a flexible plastics material with a number of adjacent ice cube compartments 12 formed in the tray body 11. After water is frozen in the ice cube compartments 12, ice cubes can be expelled from the compartments 12 by (1) inverting the tray 10 from its position in FIG. 1, and (2) gently flexing the tray 10 in the vicinity of those ice cube compartments 12 from which ice cubes are desired to be dropped into a glass or container (not shown) over which the ice cube compartments 12 are placed.

In the present embodiment, the tray 10 has a total of 16 ice cube compartments 12. The compartments are defined by a tray center wall 14 aligned with the longitudinal center line of the tray 10, and compartment walls 16 running perpendicular to the center wall 14 at left and right half portions 18, 20 of the tray 10 as viewed in FIG. 1.

Left tray portion 1 and right tray portion 20 each have eight ice cube compartments 12 and are set a certain distance apart from one another by a margin space 22 as shown in FIG. 1.

The body 11 of the dispenser tray 10 has a generally rectangular solid shape with a pair of long upper edges **24*a*, 24*b* of uniform thickness, and short upper edges 26*a*, 26*b* which blend uniformly with the long upper edges 24*a*, 24*b* at the four upper corners of the tray 10**.

In order to facilitate filling of the tray 10 with water uniformly in all of the ice cube compartments 12, cut-away parts 28 are defined at the intersections of the compartment walls 16 with the tray center wall 14. When filling the tray 10 with water into one of the compartments 12, as the water level reaches the height of the cut-away part 28 the water will spill over into neighboring compartments 12, thus maintaining a uniform water fill level in all of the compartments 12 regardless of which compartments water is initially added to for purposes of filling the tray 10.

Sets of guide channels **30*a*, 30*b* are formed on corresponding long upper edges 24*a*, 24*b* of the tray 10. Each of the guide channels 30*a*, 30*b* has a pair of parallel slots S1, S2 formed along an inside wall of the channel, the slots S1, S2 extending over the length of the tray 10 just above the ice cube compartments 2. The slots S1, S2 are terminated or blocked at end walls 32 on each of the guide channels 30*a*, 30*b***. The guide channels and the tray can be formed or molded integrally using conventional plastics molding technology.

Figure 2:
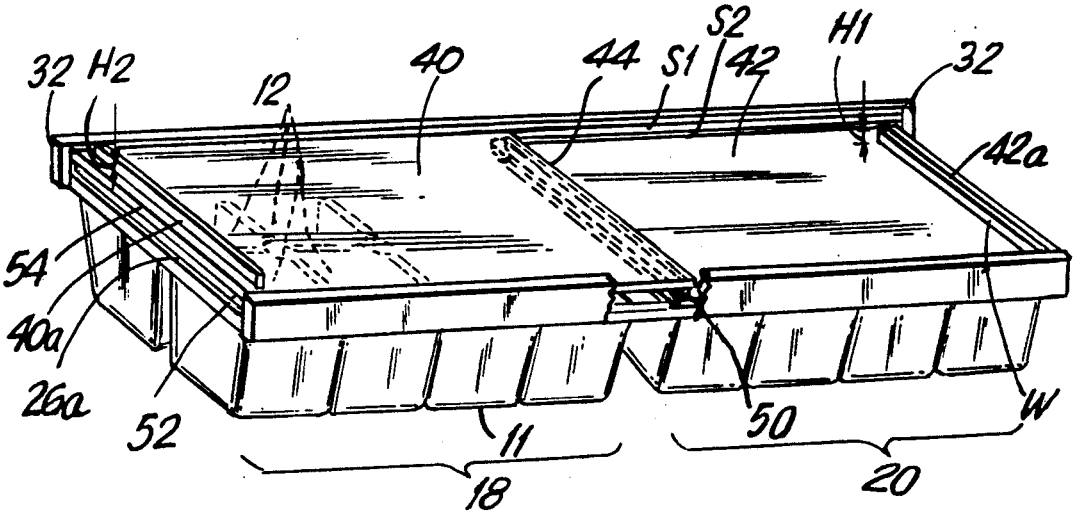
FIG. 2 is a detail view of the ice cube tray of FIG. 1 showing a pair of compartment cover panels guided for sliding movement just above ice cube compartments in the tray.

FIG. 2 is a detail view of the tray of FIG. 1 showing a pair of ice cube compartment cover panels 40, 42. The panels 40, 42 are rectangularly shaped of equal size, and are made of a fairly rigid plastics material that may be clear, opaque or color-tinted. Each of the panels 40, 42 has a finger grip part 40*a*, 42*a* in the form of a narrow straight bar that extends near a free end of the panel.

The cover panels 40, 42 are arranged to slide just above the ice cube compartments 12 in corresponding slots S1, S2 of the guide channels 30*a*, 30*b*. Each of the panels 40, 42 is of a size sufficient to cover the top openings of all eight ice cube compartments 12 of either the left tray portion 18 or right tray portion 20. The length of each panel is thus about one-half that of the entire tray body 11. The end walls 32 act as stops to prevent the free ends of the cover panels 40, 42 from protruding beyond the short upper edges 26*a*, 26*b* of the tray body Il, thus keeping the cover panels 40, 42 in place on the tray 10 and confining the movement of the panels when used, as explained below. The cover panel 40 slides in the upper slots S1, while the other panel 42 slides in the lower slots S2 of the guide channels 30*a*, 30*b*. The panels can therefore be moved one over the other. The height HI of the finger grip part 42*a* of the cover panel 42 projects upwardly an amount sufficient to abut or bound the path of movement of the confronting inner end 44 of the panel 40. The height HI may therefore be greater than the height H2 of finger grip part 40*a*. Although shown as flat in FIG. 2, the inside facing side wall W of grip part 42*a* may be concave or indented for purposes of firmly seating the inner end 44 of the panel 40 when wall W is in abutment with the panel inner end 44.

To ensure maximum water tightness and prevent spills after the compartments 12 are filled with water and the panels 40, 42 are fully drawn over the left and right tray portions 18, 20, water sealing beads 50, 52 project downwardly from the underside of the panel 40 near its inner end 44 and outer end 54. Beads 50, 52 may be formed of the same material as the panel 40 or from separate elastomeric pieces. Bead 50 maintains a pressure seal with the top surface of panel 42, and bead 52 seals against the short upper edge 26*a* of the tray body 11.

Figure 3:
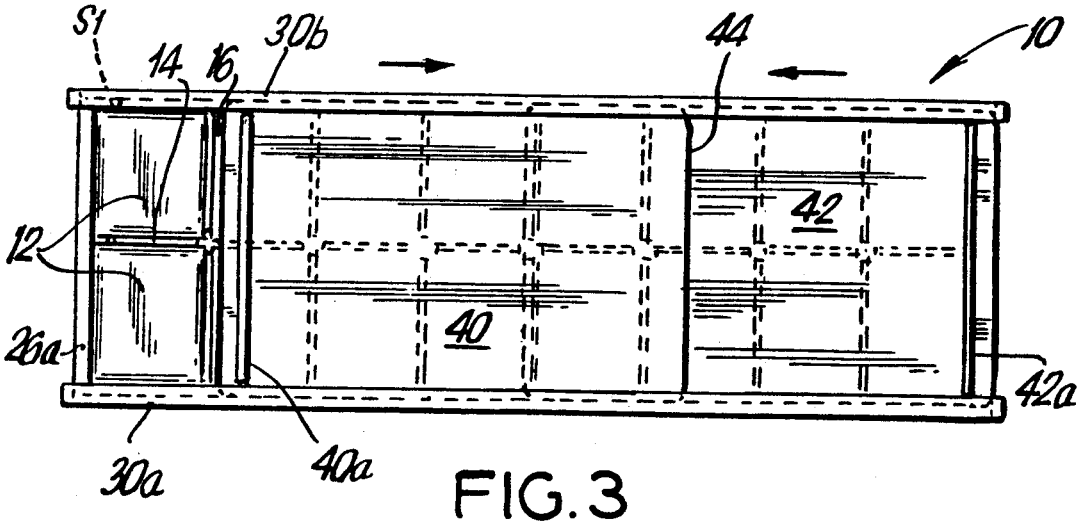
FIG. 3 is a top plan view of the ice cube tray of FIG. 1 showing a left cover panel moved to such a position as to expose ice cube compartments at the left-most end of the tray.

FIG. 3 is a plan view of the tray of FIG. 1, showing the cover panels 40, 42 set to expose a pair of ice cube compartments 12 at the left end of the tray 10. As may be seen in FIG. 3, after ice cubes in the left-most compartments 12 of the tray 10 are dispensed, the panel 40 is moved further to the right to expose a second pair of compartments 12 for dispensing of ice cubes in those compartments. After the panel 40 is moved all the way to the right, i.e., with its inner end 44 in abutment with the grip part 42*a* on the panel 42, all the ice cube compartments 12 of the left tray portion 18 have been exposed for dispensing ice cubes. Ice cubes remaining in the right tray portion 20 may then be dispensed by moving the cover panel 42 toward the left together with the abutting panel 40 to expose successive pairs of ice cube compartments 12 in the right tray portion 20 of the tray 10.

While the foregoing description represents a preferred embodiment of the invention, it will be obvious to those skilled in the art that various changes and modifications may be made without departing from the true spirit and scope of the invention as pointed out in the following claims.

WHAT I CLAIM IS:

1. An ice cube dispenser tray, comprising:

an elongate ice cube tray body having separate ice cube compartments arranged successively along the long direction of said tray, a pair of compartment cover panels, and means associated with said tray body for guiding said pair of cover panels for sliding movement just above said ice cube compartments so that ice cubes are dispensed out of the tray body only from those compartments that are exposed by movement of said cover panels.

2. An ice cube dispenser tray according to claim 1, wherein said ice cube tray body has a pair of long upper edges and a pair of short upper edges, and said guiding means includes guide channels extending above the long upper edges of said ice cube tray body.

3. An ice cube dispenser tray according to claim 1, wherein said ice cube tray body is of rectangular shape, and each of said cover panels is generally rectangularly shaped with a length that is about one-half that of said tray body.

4. An ice cube dispenser tray according to claim 2, wherein said pair of cover panels includes an upper cover panel and a lower cover panel, and each of said panels is arranged to slide in a different set of guide panels so that the panels move one over the other.

5. An ice cube dispenser tray according to claim 4, wherein each of said cover panels has a finger grip part projecting upwardly near a free end of the panel.

6. An ice cube dispenser tray according to claim 5, wherein the finger grip part associated with said lower cover panel projects upwardly by an amount sufficient to bound the path of movement of a confronting free end of said upper cover panel.

7. An ice cube dispenser tray according to claim 2, including panel stop means associated with said guiding means for preventing free ends of said cover panels from protruding beyond the short upper edges of the ice cube tray body.

8. An ice cube dispenser tray according to claim 1, including sealing means associated with said cover panels for preventing leakage of water out of said ice cube compartments when said panels are drawn over the compartments.

9. An ice cube dispenser tray according to claim 8, wherein said sealing means includes a seal member between said panels.

10. An ice cube dispenser tray according to claim 8, wherein said sealing means includes a seal member between one of said panels and a part of said tray body.

11. An ice cube dispenser tray according to claim 2 wherein said guide channels are formed integrally with the ice cube tray body.

12. An ice cube dispenser tray according to claim 1, wherein each of said cover panels is of such a size as to cover less than all of aid ice cube compartments.

13. An ice cube dispenser tray according to claim 1, wherein said ice cube tray body comprises a left tray portion and a right tray portion, and said tray portions are set a predetermined distance apart from one another by a margin space.

14. An ice cube dispenser tray according to claim 2, wherein said ice cube tray body is rectangular shaped, and said short upper edges blend uniformly with said long upper edges at upper corners of the tray body.

15. An ice cube dispenser tray according to claim 1, wherein cut-away means are defined between the ice cube compartments of said ice cube tray body for maintaining a substantially uniform water level in all of said compartments after adding water initially to only some of said compartments when filling the dispenser tray with water.

* * * * *